United States Patent [19]

Kashiwagi

[11] Patent Number: 4,508,331

[45] Date of Patent: Apr. 2, 1985

[54] SHEET FEEDER

[75] Inventor: Atumi Kashiwagi, Osaka, Japan

[73] Assignee: Fujimoto Photo Industrial Co., Ltd., Osaka, Japan

[21] Appl. No.: 471,262

[22] Filed: Mar. 2, 1983

[51] Int. Cl.[3] ..... B65H 3/08

[52] U.S. Cl. ..... 271/107; 271/902

[58] Field of Search ..... 271/20, 100, 101, 106, 271/107, 11, DIG. 9

[56] References Cited

U.S. PATENT DOCUMENTS 3,352,216 11/1967 Wainberg ..... 271/107 X

FOREIGN PATENT DOCUMENTS 251509 9/1927 United Kingdom ..... 271/107

*Primary Examiner*—Richard A. Schacher

*Attorney, Agent, or Firm*—Koda and Androlia

[57] ABSTRACT

A feeder has a link mechanism comprising a connecting rod, an intermediate arm and a pivotal arm. The uppermost sheet is lifted at its front end rearwardly upward first and is then sent forward by a sucking disk supported by the pivotal arm.

11 Claims, 5 Drawing Figures

SHEET FEEDER

BACKGROUND OF THE INVENTION

The present invention relates to a sheet feeder for forwardly dispensing stacked rectangular sheets one by one from the uppermost position, and more particularly to a film feeder for use in automatic film loaders for automatically feeding medical roentgenographic or tomographic rectangular films to the exposure position one by one.

Conventional sheet feeders comprise a pivotal arm movable forward and backward about a pivot point above a stack of sheets, and a sucking disk mounted on the pivotal arm and movable upward and downward. When attracting a sheet, the sucking disk moves vertically to lift the front portion of the sheet vertically upward, and the arm thereafter pivotally moves to send out the sheet forward. The sucking disk is adapted to attract the sheet by a vacuum supplied from outside.

Accordingly, when the front portion of the sheet is lifted vertically upward, a reduced pressure produced beneath the sheet at its center portion attracts the underlying sheet, entailing the likelihood that more than one sheet will be sent out.

Especially because synthetic resin sheets such as photographic films are easily chargeable electrostatically and intimately adhere to each other, the feeder of the above construction encounters difficulties in preventing double feeding.

Furthermore, the conventional feeder, which requires a vacuum for sucking or attracting the sheet, necessitates a vacuum device. It is nevertheless difficult to use such a vacuum device for small-sized movable feeders for cameras.

While conventional feeders have a plurality of sucking disks, it is likely that the vacuum piping system will be plugged up or the vacuum channel for one of the sucking disks will be clogged with dust or the like. In such an event, the sucking disk concerned no longer exerts suction, and the resulting uneven suction could lead to misfeeding.

SUMMARY OF THE INVENTION

An object of the present invention is to provide a sheet feeder comprising a link mechanism and adapted to temporarily lift the front end of the uppermost sheet rearwardly upward and to thereafter send out the sheet forward so as not to produce a reduced pressure between the uppermost sheet and the underlying sheet for the prevention of double feeding.

Another object of the invention is to provide attracting means which does not require any vacuum supply source for attracting sheets to thereby preclude a failure in attracting the sheets.

Other objects of the invention will become apparent from the following description and the accompanying drawings.

DESCRIPTION OF THE PREFERRED EMBODIMENTS

Figure 1:
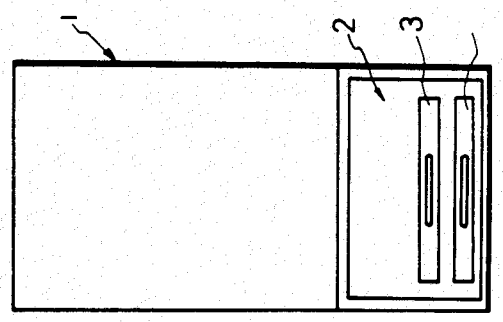
FIG. 1 is a rear view showing a tomographic camera.

FIG. 1 is a rear view showing a tomographic camera 1 equipped with an automatic film loader (film autoloader) 2. The film autoloader 2 is adapted to deliver rectangular films from a feeding cassette 3 one by one, transport each film to the exposure position and accommodate the film in a receiving cassette 4 after exposure.

Figure 2:
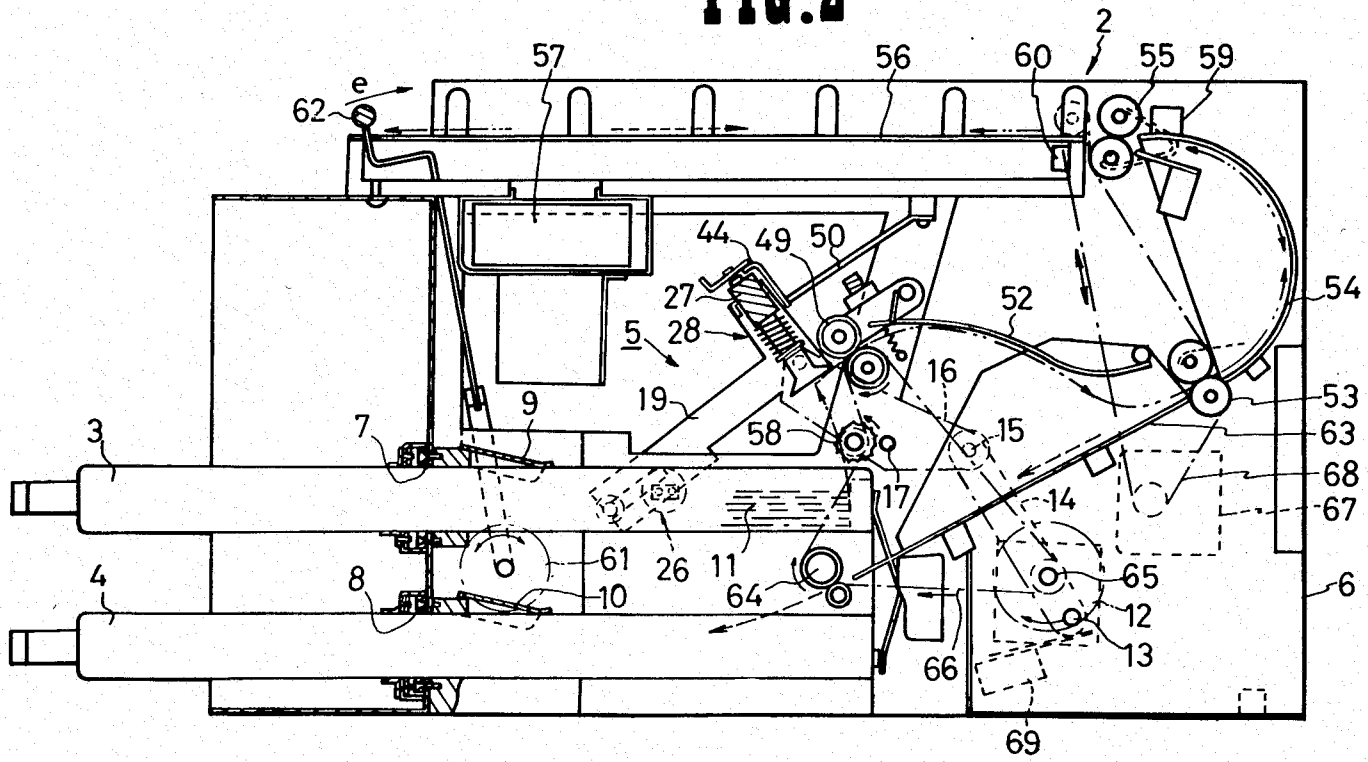
FIG. 2 is a sectional view showing an automatic film loader.

FIG. 2 shows the construction of the film autoloader 2 in detail. The autoloader 2 includes a sheet feeder 5 of the present invention.

The autoloader 2 has a box-shaped frame 6 the rear side of which is formed with a feeding cassette inserting opening 7 and a receiving cassette inserting opening 8 as arranged one above the other. These openings 7 and 8 are closable with covers 9 and 10, which are automatically opened by inserting the cassettes and automatically closed by removing the cassettes to render the interior of the frame 6 serviceable as a darkroom.

The feeding cassette 3 to be inserted through the upper opening 7 has accommodated therein a stack of unexposed films 11 in the form of rectangular sheets. The cassette 3 is provided with means for positioning the films 11 in place in accordance with the size of the film. The feeding cassette 3 has a slide cover for openably closing its front upper portion. The slide cover is not openable or closable unless lock means is released. When the slide cover is opened on releasing the lock means, the films 11 can be dispensed from the cassette. When the slide cover is opened with the cassette 3 inserted through the opening 7, the cassette 3 is locked to the frame 6. In this state, the cassette 3 is not removable from the frame 6. To draw out the cassette 3, the slide cover must be closed. With the use of such an arrangement, the films 11 within the cassette is prevented from being inadvertently exposed to light.

The receiving cassette 4 to be inserted through the lower opening 8 is the same as the above cassette 3. The cassette 4 is loaded into the frame 6 in an empty state for containing exposed films.

The films 11 placed in the feeding cassette 3 are dispensed from the uppermost position one by one by the sheet feeder 5 of the invention and transported forward.

Figure 3:
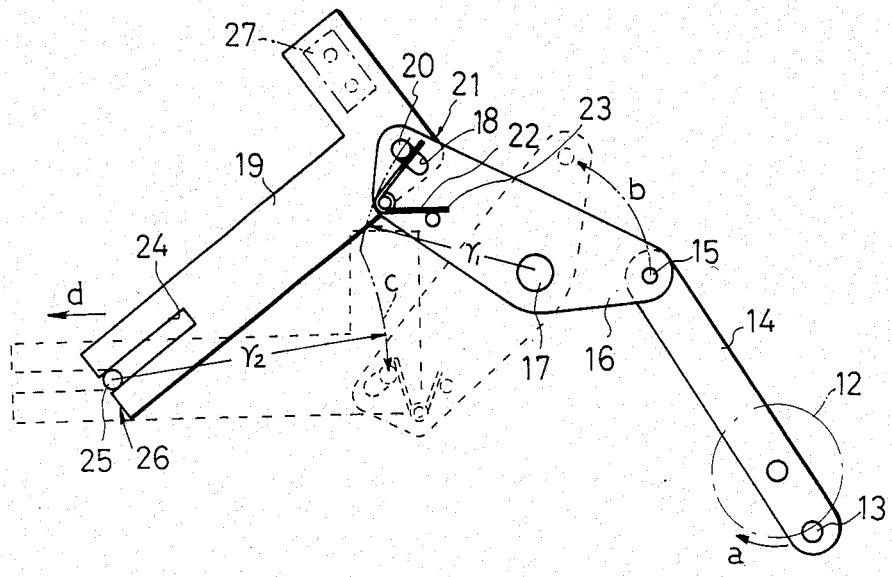
FIG. 3 is a side elevation showing the drive mechanism of a sheet feeder.

With reference to FIG. 3, the sheet feeder 5 has a crank motor 12 on one side of the frame 6 in front of and below the front end of the feeding cassette 3. The motor 12 revolves a crank pin 13 in one direction. A connecting rod 14 has one end connected to the crank pin 13 and the other end pivoted to an intermediate arm 16 by a pin 15. The intermediate arm 16 is supported at an intermediate portion thereof by a pivot 17 fixed to a side portion of the frame 6 and is turnable upward or downward. The pivot 17 is positioned close to the front end upper portion of the feeding cassette 3. The intermediate arm 16 is formed at its rear end with a slit 18 extending longitudinally thereof.

Pivotably connected to the rear end of the intermediate arm 16 is a pivotal arm 19 which is fixedly provided at its front end with a pin 20. The pin 20 is rotatably and movably fitted in the slit 18 to constitute a front connection 21. The outer end of the pin 20 extending through the slit 18 is in engagement with one end of a spring 22 the other end of which bears on a holding pin 23 projecting from the intermediate arm 16. The spring 22 biases the pin 20 into pressing contact with the edge of the arm 16 defining the rear end of the slit 18.

The pivotal arm 19 is formed at its rear end with a slit 24 extending longitudinally thereof. A pin 25 fixed to a side portion of the frame 6 is fitted in the slit 24 and the arm 19 is rotatably and movably coupled to the pin 25 thereby. The fitting engagement of the pin 25 in the slit 24 provides a rear connection 26. The pin 25 is positioned to the rear of the front end of the feeding cassette 3 approximately at the same level as the top of the stack of films 11. The rear connection 26 is positioned below the front connection 21.

Another intermediate arm 16 is disposed at the other side of the frame 6 to form a pair with the abovementioned arm 16 in opposed relation thereto. Similarly disposed is another pivotal arm 19 to form a pair with the foregoing arm 19. The front ends of the pair of pivotal arms 19 are interconnected by a connecting arm 27. The connecting arm 27 is provided with four sheet attracting means 28 as arranged transversely of the frame 6.

Figure 4:
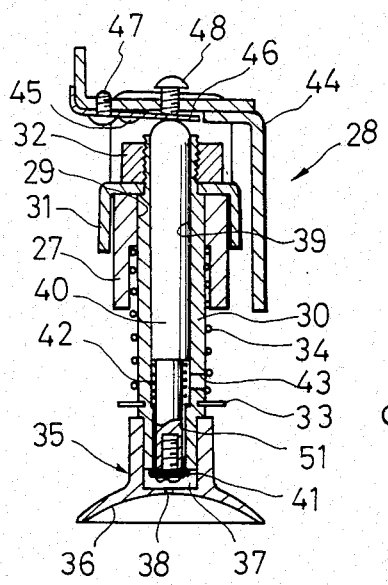
FIG. 4 is a sectional view showing attracting means.

FIG. 4 shows the attracting means in detail. The connecting arm 27 has four bores 29 each adapted to insert therethrough a sucking disk tubular stem 30 slidably. The upper end of the stem 30 projects upward from the bore 29, and a stem mount plate 31 is secured to the projecting portion by a nut 32. The mount plate 31 bears on the upper surface of the connecting arm 27 to prevent the disk stem 30 from slipping off downward. A retainer ring 33 is fixed to a lower portion of the stem 30. A coiled compression spring 34 is provided between the upper side of the retainer ring 33 and the lower side of the connecting arm 27 for biasing the disk stem 30 downward. When the disk stem 30 is pushed upward against the spring 34, the stem 30 moves relative to the connecting arm 27 while compressing the spring 34.

A sucking disk 35 is secured to the lower end of the disk stem 30. The sucking disk 35 has a parabolic cavity 36, and a valve chamber 37 is formed between the rear side of the disk and the end face of the disk stem 30. The cavity 36 communicates with the valve chamber 37 through a hole 38 formed in the sucking disk 35. The sucking disk 35 is made of rubber or a soft synthetic resin.

An inner channel 39 communicating with the valve chamber 37 extends through the sucking disk stem 30 coaxially therewith, and a valve stem 40 slidably extends through the inner channel 39. A valve element 41 fixed to the lower end of the valve stem 40 is adapted to come into contact with the end face of the disk stem 30 to thereby hold the channel 39 out of communication with the valve chamber 37. A compressing spring 42 is housed in the channel 39 for biasing the valve stem 40 upward. The force of the spring 42 causes the valve element 41 to close the inner channel 39.

An air intake port 43 communicating with the inner channel 39 is formed in a side portion of the disk stem 30. The upper end of the valve stem 40 projects upward from the inner channel 39. A valve lever 44 is adapted to depress the upper end of the valve stem 40.

The valve lever 44 is rotatably mounted on a rod 45 transversely extending between the pair of pivotal arms 19. The rod 45 is positioned to the rear of the axis of the disk stem 30 and approximately at the same level as the upper end of the valve stem 40. The valve lever 44 extends over the valve stem 40 and is bent downward in front of the disk stem 30. A tongue piece 46 bearing on the upper end of the valve stem 40 is fixed to the lower side of the lever 44 by a fastening screw 47. An adjusting screw 48 for pressing each tongue piece 46 is mounted on the valve lever 44 so that the tongue pieces 46 for the four valve stems 40 will bear on the upper ends of the valve stems 40 with a uniform pressure.

Next, the operation of the sheet feeder 5 will be described with reference to FIG. 3. When the crank pin 13 is revolved by the crank motor 12 in the direction of arrow a shown, the front end of the intermediate arm 16 pivoted to the connecting rod 14 moves in the direction of arrow b shown. With this movement of the intermediate arm 16, the pivotal arm 19 moves in the direction of arrow c. The locus indicated by the arrow c is one of the features of the present invention.

The locus of the arrow c will be described in greater detail with reference to FIG. 3. With the movement of the intermediate arm 16 in the direction b, the front end of the pivotal arm 19, as located in a raised position, moves along a circular arc centered about the pivot 17 and having a radius $r_1$. At this time, the pin 20 of the front connection 21 is pressed by the spring 22 against the edge defining the rear end of the slit 18.

By virtue of the engagement of the pin 25 in the slit 24, the rear end of the pivotal arm 19 moves in the direction of arrow d. After the pivotal arm rear end has moved a predetermined amount, the edge of the arm 19 defining the front end of the slit 24 strikes against the pin 25. This renders the rear end of the pivotal arm 19 no longer movable rearward. In this state, however, the front connection 21 of the pivotal arm 19 acts to pivotally move downward, so that the pin 20 of the front connection 21 moves through the slit 18 against the spring 22. Consequently, the front end of the pivotal arm 19, as positioned in a lowered position, moves along a circular arc centered about the pin 25 of the rear connection 26 and having a radius of $r_2$.

It therefore follows that the sucking disks 35 of the attracting means 28 coupled to the pivotal arms 19 by the connecting arm 27 move along the locus c. At the lowermost end of the locus c, each sucking disk 35 comes into contact with the upper surface of the uppermost film 11 at its front end, whereby the air within the cavity 36 of the sucking disk 35 is expelled for the disk 35 to attract the film 11.

Subsequently the crank pin 13 further revolves in the same direction, causing the front end of the pivotal arm 19 to move reversely along the same locus c and return to the original position. Accordingly the sucking disk 35 moving with the pivotal arm 19 and holding the film 11 attracted thereto moves the front end of the film 11 rearwardly upward about the pin 25. Since the disk 35 thus lifts the film 11 at its front end, the uppermost film 11 is separated from the underlying film, with a space formed therebetween progressively rearward, without producing a reduced pressure between the films. As a result, double feeding is prevented.

After lifting the uppermost film 11 rearwardly upward as above, each sucking disk 35 moves forward about the pivot 17 along the locus c. When the disk 35 reaches the foremost end of the locus c, the front end of the film is held between a pair of upper and lower nipping rollers 49 as seen in FIG. 2.

At this time, the valve lever 44 of the attracting means comes into contact with a stopper member 50 as shown in FIG. 2, whereby the valve lever 44 is rotated about the rod 45, causing the tongue piece 46 to push the valve stem 40 downward against the spring 42. This movement brings the valve element 41 out of contact with the end face of the disk stem 30 to permit the inner channel 39 to communicate with the valve chamber 37. Consequently the valve chamber 37 communicates with the atmosphere through an air passageway 51 comprising the inner channel 39 and the air intake port 43. Thus air is supplied to the cavity 36 of the sucking disk 35 to release the film 11 from the disk 35.

The film 11 released from the disk 35 is forwarded by the nipping rollers 49, then guided by a guide member 52 and further sent forward by first feed rollers 53. The film 11 is sent upward while being reversed by a reversing guide member 54 and is then transported rearward by second feed rollers 55. In this state, the film 11 has been turned upside down. The film 11 is thus brought to an exposure position 56, in which the film 11 is held by the suction of a blower 57.

Although it is unlikely that two films 11 will be dispensed from the cassette 3 at the same time, safety means are provided for precluding the possible accidental double feeding.

One of the safety means is a separating roller 58 which is adapted to come into contact with the front edge of the film 11 when the film is lifted from the cassette 3 to scrape off the second film, if any. The roller 58 has projections on its outer periphery. Another safety means is a double feed sensor 59. Also provided is a misfeed sensor 60 for detecting the absence of the film which should be fed.

After the film 11 in the exposure position has been exposed, a return lever 62 movable by a rotary solenoid 61 moves in the direction of arrow e to push back the film 11 from the exposure position 56. When returning the film, the first and second feed rollers 53 and 55 are in reverse rotation. Accordingly the film 11 is nipped between the second feed rollers 55 and sent in the reverse direction along the reversing guide member 54 and reaches the first feed rollers 53. The film 11 is thereafter guided by a return guide member 63 and reaches third feed rollers 64, which place the film into the receiving cassette 4. With this, one cycle is completed.

The nipping rollers 49, the separating roller 58 and the third feed rollers 64 are driven in one direction at all times by a chain 66 coupled to a motor 65.

The first feed rollers 53 and the second feed rollers 55 are driven by a reversibly rotatable motor 67 through a chain 68. The crank pin 13 actuates a limit switch 69 for changing the direction of rotation of the reversible motor 67 and for energizing the rotary solenoid 61.

Figure 5:
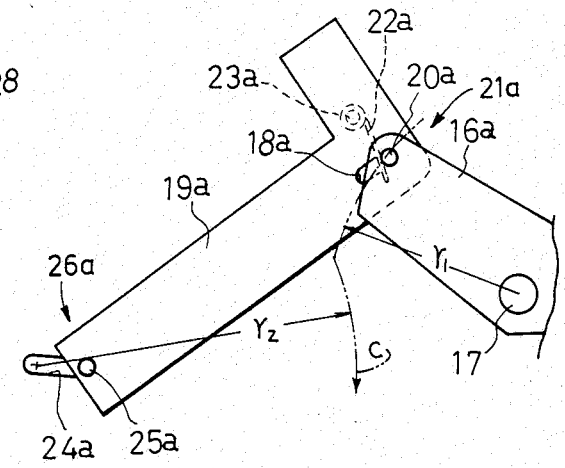
FIG. 5 is a fragmentary side elevation on an enlarged scale showing another embodiment.

FIG. 5 shows another embodiment of the invention, wherein a front connection **21*a* is provided by the engagement of a pin 20*a* on the rear end of an intermediate arm 16*a* in a slit 18*a* formed at the front end of a pivotal arm 19*a* and extending longitudinally thereof. A spring 22*a* has one end held by the pin 20*a* and the other end engaged by a holding pin 23*a* mounted on the pivotal arm 19*a*. The spring 22*a* presses the pin 20*a* against the edge of the arm 19*a* defining the front end of the slit 18*a***.

A rear connection **26*a* is provided by the fitting engagement of a pin 25*a* on the rear end of the pivotal arm 19*a* in a slit 24*a* formed in a frame 6** longitudinally thereof.

The second embodiment has the same construction as the first with the exception of the above feature. As in the first embodiment, the front end of the pivotal arm **19*a*** moves along a locus c.

The present invention is not limited to the above embodiments. For example, the invention can be embodied as a sheet feeder for feeding tinplate, paper or like sheets.

The present invention has the advantage that since the front end of the uppermost sheet is temporarily lifted rearwardly upward, the space between the uppermost sheet and the next underlying sheet progressively widens from the front end rearward, completely separating the uppermost sheet from the underlying sheet and consequently precluding double feeding.

The invention has another advantage that the attracting means wherein no vacuum is used render the apparatus simple in construction and permit the sucking disks to exert a uniform attracting force to prevent misfeeding.

What is claimed is:

1. A sheet feeder for forwardly dispensing stacked rectangular sheets one by one from the uppermost position comprising a connecting rod 14 having one end connected to a crank pin 13 revolvable in one direction; an intermediate arm 16 having a front end pivoted to the other end of the rod 14 and an intermediate portion supported by a pivot 17 on a fixed frame, the arm 16 being pivotally movable upward and downward; a pivotal arm 19 having a front end coupled to the rear end of the arm 16 by a front connection 21 provided by a pin 20 and a slit 18 and a rear end positioned to the rear of the front end of the stack of sheets 11 and below the front connection 21 and coupled to the fixed frame by a rear connection 26 provided by a pin 25 and a slit 24; and sheet attracting means 28 disposed at the front end of the pivotal arm 19 and movable about the pivot 17 when in a raised position away from the top of the stack of sheets 11, by the pivotal movement of the pivotal arm 19 effected by the revolution of the crank pin 13 through the connecting rod 14 and the intermediate arm 16, the sheet attracting means 28 being movable about the pin 25 of the rear connection 26 when in a lowered position close to the top of the stack of sheets 11.

2. A sheet feeder as defined in claim 1 wherein the slit 18 is formed in the rear end of the intermediate arm 16 longitudinally thereof, and the pin 20 is mounted on the front end of the pivotal arm 19 and fitting in the slit 18 movably and rotatably to provide the front connection 21, the pin 20 being biased into contact with the edge of the intermediate arm 16 defining the rear end of the slit 18.

3. A sheet feeder as defined in claim 1 wherein the slit **18*a* is formed in the front end of the pivotal arm 19*a* longitudinally thereof, and the pin 20*a* is mounted on the rear end of the intermediate arm 16*a* and fitting in the slit 18*a* movably and rotatably to provide the front connection 21*a*, the pin 20*a* being biased into contact with the edge of the pivotal arm 19*a* defining the front end of the slit 18*a***.

4. A sheet feeder as defined in claim 2 wherein the spring 22 has one end engaged by the intermediate arm 16 and the other end engaged by the pin 20.

5. A sheet feeder as defined in claim 3 wherein the spring **22*a* has one end engaged by the pivotal arm 19*a* and the other end engaged by the pin 20*a***.

6. A sheet feeder as defined in claim 1 wherein the slit 24 is formed in the rear end of the pivotal arm 19 longitudinally thereof, and the pin 25 is mounted on the fixed frame and fitting in the slit 24 movably and rotatably to provide the rear connection 26.

7. A sheet feeder as defined in claim 1 wherein the slit **24*a* is formed in the fixed frame longitudinally thereof, and the pin 25*a* is mounted on the rear end of the pivotal arm 19***a* and fitting in the slit 24*a* movably and rotatably to provide the rear connection 26*a*.

8. A sheet feeder as defined in claim 1 wherein the rear connection 26 is positioned approximately at the same level as the top of the stack of sheets.

9. A sheet feeder as defined in claim 1 wherein a pair of pivotal arms 19 and a pair of intermediate arms 16 are provided at opposite sides of the frame 6 of the sheet feeder, and the front ends of the pair of pivotal arms 19 are interconnected by a transverse connecting arm 27, the sheet attracting means 28 being mounted on the connecting arm 27.

10. A sheet feeder as defined in claim 9 wherein the connecting arm 27 is provided with a plurality of sheet attracting means 28 as arranged longitudinally of the arm 27 for holding the front end upper surface of the sheet 11 attracted thereto.

11. A sheet feeder as defined in claim 10 wherein each of the sheet attracting means 28 comprises a sucking disk stem 30 mounted on the connecting arm 27, and a sucking disk 35 secured to the forward end of the disk stem 30 and having a parabolic cavity 36, the disk stem 30 being formed with an air passageway 51 for causing the cavity 36 to communicate with the atmosphere, the disk stem 30 having inserted therethrough a valve stem 40 for opening and closing the air passageway 51, the valve stem 40 being pushable by contact with a stopper member 50 on the fixed frame when the sheet 11 held attracted to the sucking disk 35 is lifted upwardly forward, to open the air passageway 51 and supply atmospheric air to the cavity 36 for releasing the sheet 11 from the sucking disk 35.

* * * * *